United States Patent [19]

Haertle

[11] 4,195,627

[45] Apr. 1, 1980

[54] BREATHING APPARATUS WITH FLOW CONTROL

[75] Inventor: Klaus Haertle, Berlin, Fed. Rep. of Germany

[73] Assignee: Auergesellschaft GmbH, Berlin, Fed. Rep. of Germany

[21] Appl. No.: 924,996

[22] Filed: Jul. 17, 1978

[30] Foreign Application Priority Data

Jul. 26, 1977 [DE] Fed. Rep. of Germany ..... 2733601

[51] Int. Cl.[2] ..... A62B 7/08; A62B 7/10

[52] U.S. Cl. ..... 128/202.26; 128/205.28

[58] Field of Search ..... 128/142 R, 142.2, 142.3, 128/142.4, 142.6, 147, 191 R, 202; 55/DIG. 33, DIG. 35

[56] References Cited

FOREIGN PATENT DOCUMENTS 187553 3/1967 U.S.S.R. ..... 128/142.2

*Primary Examiner*—Henry J. Recla

*Attorney, Agent, or Firm*—Brown, Flick & Peckham

[57] ABSTRACT

The outlets of an oxygen liberating canister and a carbon dioxide absorbing canister are connected with a breathing bag that has an outlet connected to an inhalation tube. An exhalation tube is connected with the canister inlets. A valve system controls the proportion of exhaled air flowing through each canister, from 100% to zero, the system being actuated by the breathing bag as the bag is inflated and deflated.

8 Claims, 4 Drawing Figures

BREATHING APPARATUS WITH FLOW CONTROL

The invention concerns a chemical-oxygen apparatus with a respiration circuit, hereinafter called breathing apparatus, which is provided with a chemical canister that liberates oxygen and with a breathing bag.

In breathing apparatus of this type, the oxygen required for breathing is produced from a chemical contained in a cartridge or in a canister, the oxygen being liberated while the exhaled carbon dioxide is being absorbed. In such a process, the removal of carbon dioxide should be as extensive as possible in order for the exhaled air passing through the chemical canister to become breathable again as inhalation air. This state of affairs is accomplished by using a correspondingly large amount of a chemical that binds the carbon dioxide and which, at the same time, liberates oxygen. However, it always produces more oxygen than is consumed by the user of the respirator. Furthermore, additional oxygen is liberated by the moisture contained in the exhaled air. This unconsumed over-production of oxygen is blown-off into the environment through a pressure relief valve located in the breathing bag.

The basic object of this invention is to create breathing apparatus of the above-described type which is so constituted that it is possible to match the production of oxygen in the chemical canister with the oxygen requirements of the user and without the need to dispose of any excess and unused oxygen. This task is achieved, in accordance with the invention, by additionally providing parallel to the chemical canister an absorber which binds the carbon dixoide and which can be switched in or out of the breathing circuit by means of control members as a function of the fullness of the breathing bag in the respiration system.

The advantages to be gained by means of the invention reside, in particular, in the fact that, as a result of the throttled oxygen development, the breathing apparatus can be operated with a holding time far above the usual value obtained in the case of known chemical-oxygen devices. Furthermore, on account of the lower amount of oxygen developed per unit time, the entire system is also cooler than previously known systems.

Forms of construction are shown by way of example in the appended drawings and will be described in greater detail below.

Figure 1A:
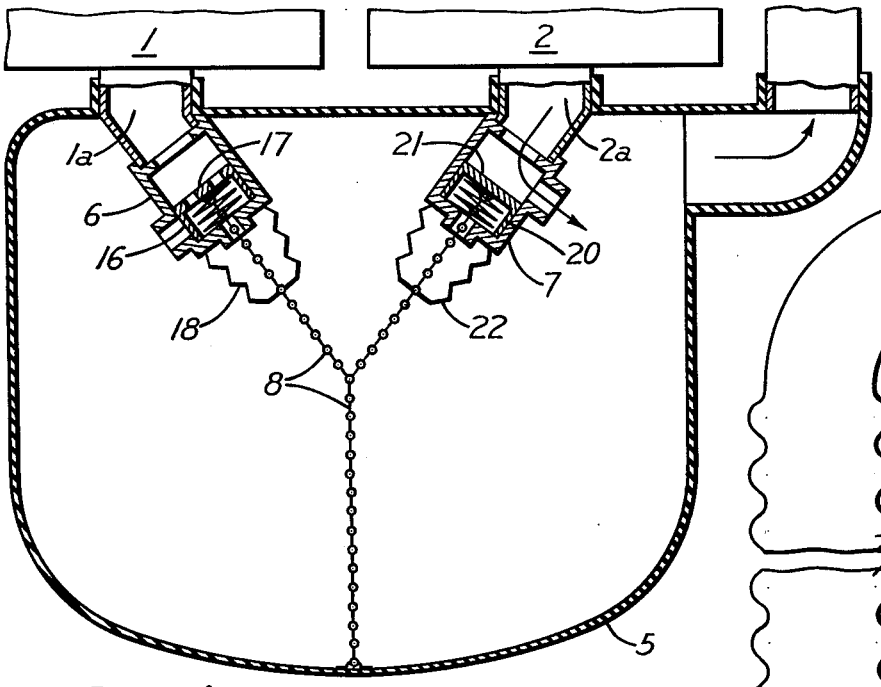
Figure 1:
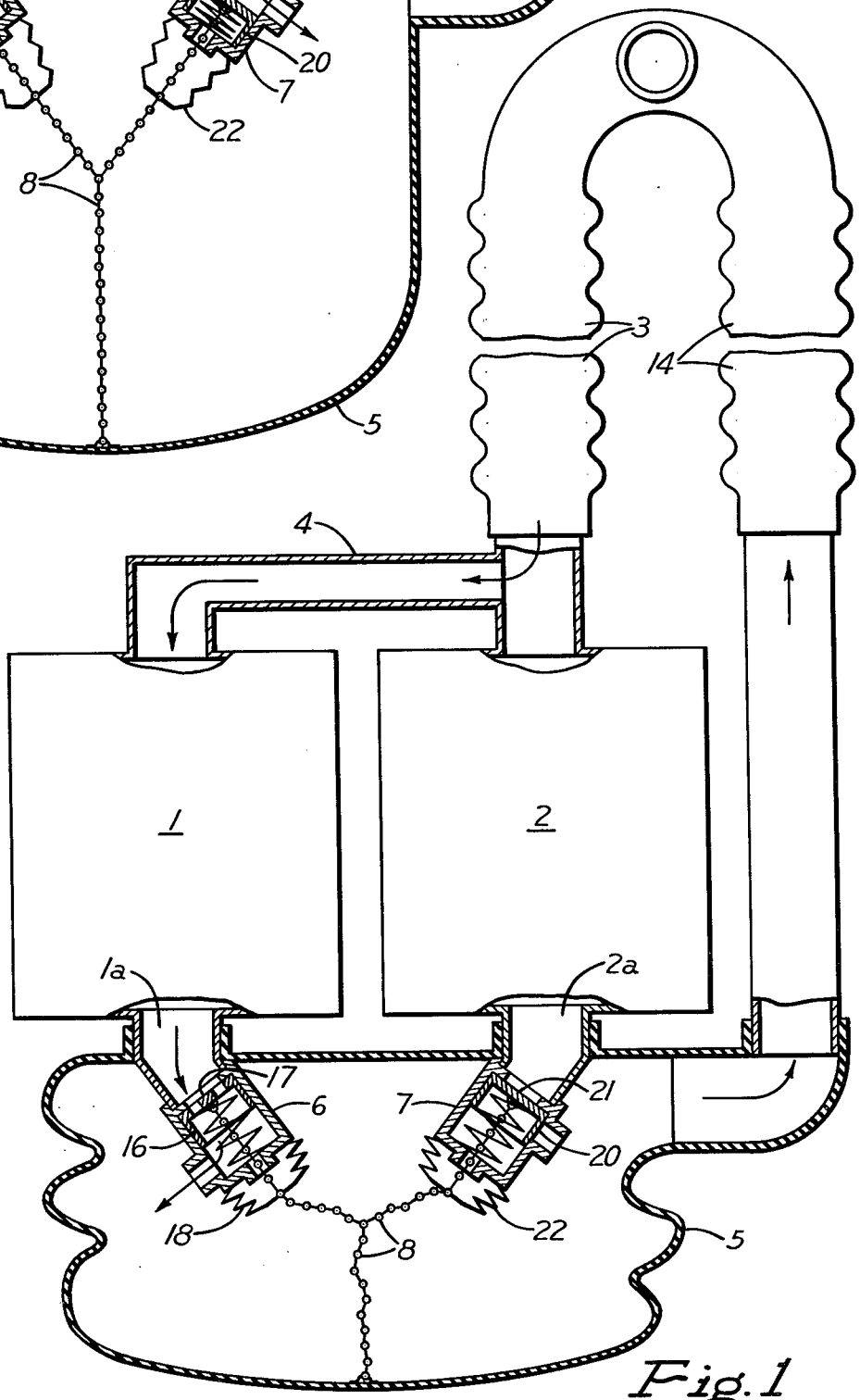
Figure 2A:
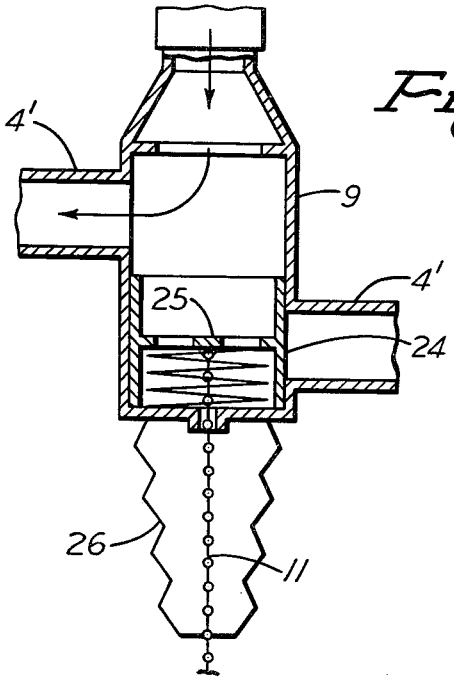
Figure 2:
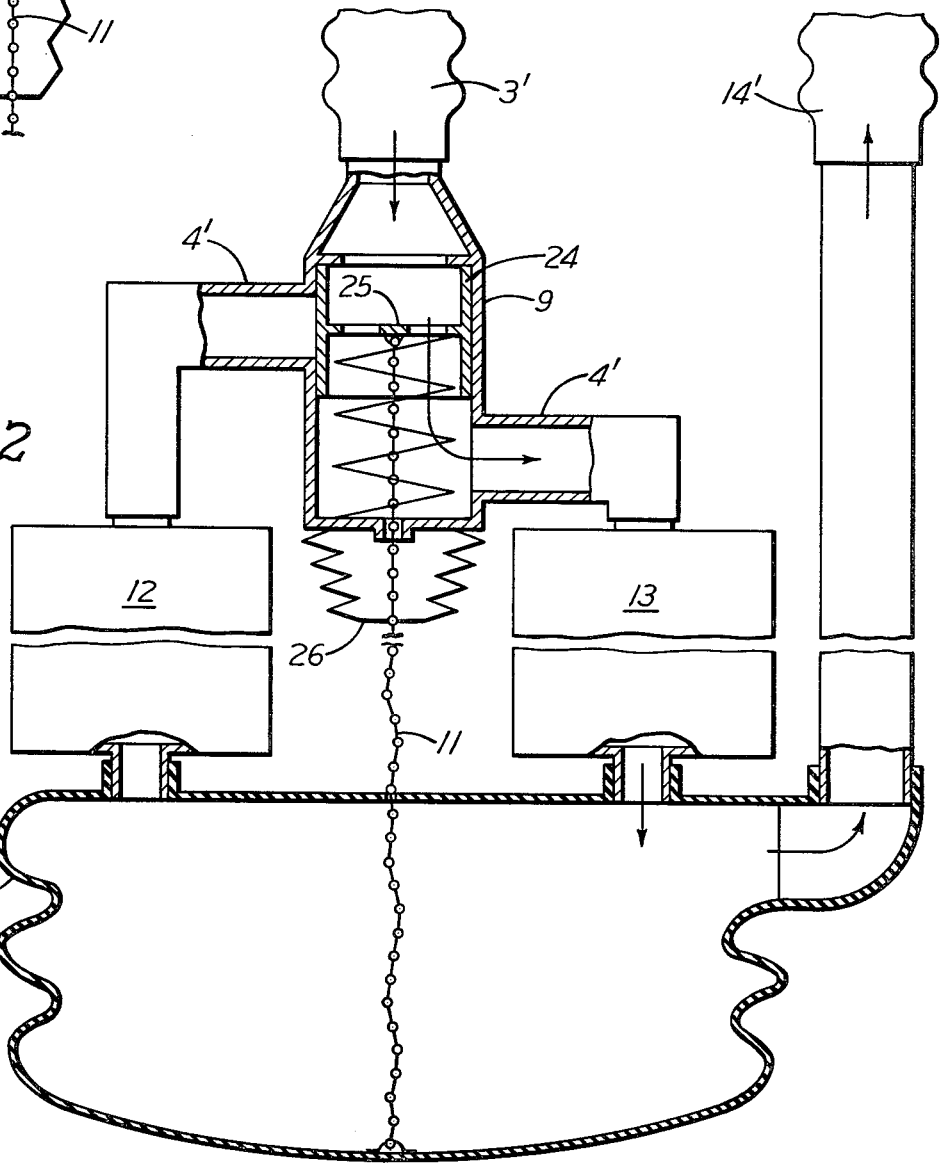

FIG. 1 presents a schematic representation of breathing apparatus made in accordance with this invention and fitted with two flow control members, one of which is closed;

FIG. 1*a* is a fragmentary section showing the breathing bag fully inflated and holding the oxygen valve closed and the other valve open;

FIG. 2 shows schematically another form of construction of the apparatus made in accordance with the invention, the apparatus being provided with a single flow control member and a deflated breathing bag; and FIG. 2*a* is a fragmentary section showing the flow control member held in its lower position by an inflated bag.

As may be seen from FIG. 1, the chemical-oxygen apparatus consists in essence of a well-known oxygen-developing canister 1, a respiration-lime canister 2 arranged in parallel with canister 1 and capable, as an additional absorbing unit, of absorbing at least half of the carbon dioxide to be absorbed; the apparatus also comprising air exhalation hose 3 connected to a conduit 4 joined to the inlets of the two canisters, the outlets 1*a* and 2*a* of which are connected to two inlets into a breathing bag 5 that is located underneath the canisters and provided with an outlet connected to an inhalation hose 14. There also are control members 6 and 7 located inside the breathing bag and, respectively, connected to the outlets of the two canisters.

The control members 6 and 7 are made in the form of valves that are actuated by a flexible line, such as a wire or chain 8, attached to the side of the breathing bag facing the valves and movable toward and away from them.

Valve 6 includes a sleeve 16 slidably mounted inside of it. A perforated wall 17 forming the upper end of the sleeve is connected to the chain 8, which extends through the bottom of the valve that is sealed by a bellows 18. When the sleeve is in its upper position, as shown in FIG. 1, exhaled air can flow down through its perforated wall and out into the bag, but when the sleeve is in its lower position shown in FIG. 1*a* the valve is closed.

Valve 7 likewise includes a sleeve 20, but its upper wall 21 is solid. It is connected to chain 8 that extends down through a bellows 22. When sleeve 20 is in its upper position shown in FIG. 1 the valve is closed, and when the sleeve is in its lower position shown in FIG. 1*a* the outlet into the bag is fully open.

The way in which the chemical-oxygen apparatus, which is constructed in the form of a circulating device, functions is as follows:

The exhaled air flows through an exhaling valve (not shown in the drawings) and through exhalation hose 3 into the conduit 4, below which are located the two canisters 1 and 2. Depending on the extent to which the breathing bag is filled, the exhaled air flows through chemical canister 1 as shown in FIG. 1 or through the respiration-lime canister 2, as shown in FIG. 1*a*, or through both the canisters when the bag is partially inflated, and into the breathing bag 5. The regenerated air from the breathing bag can then be inhaled again through the inhalation hose 14.

When the breathing bag is substantially empty, valve 7 at the exit from canister 2 is closed and the exit from canister 1 is open so that all of the exhaled air flows through chemical canister 1 and produces the maximum amount of oxygen, which passes into the breathing bag as shown in FIG. 1.

The fuller or more inflated the breathing bag becomes, the more exhaled air flows through canister 2, due to the opening of valve 7 and the closing of valve 6, in the process of which the exhaled air is freed of its carbon dioxide. When the bag is fully inflated, valve 7 is wide open and valve 6 is completely closed as shown in FIG. 1*a*.

It is clear from the above that the oxygen development of the apparatus made in accordance with the invention can be designated as being requirement-dependent, because the development of oxygen in chemical canister 1 regulates itself automatically according to the amount of water vapor and carbon dioxide produced and, in fact, is a function of the extent to which the breathing bag is filled. The extent of the filling adjusts the rate at which oxygen is developed by connecting-in or disconnecting the respiration-lime canister 2 running parallel in the system.

In the modification of FIG. 2 another advantageous form of the breathing apparatus is illustrated, in which the conduit 4' connecting exhalation hose 3' with the inlets of carbon dioxide absorbing canister 12 and oxygen generating canister 13 includes a control valve 9, the inlet of which is connected with the hose. This valve includes a sleeve 24 provided with a transverse wall 25 having holes through it for passage of air. This wall 25 also is connected to the upper end of a chain 11 that extends down out of the valve through a bellows 26. The lower end of the chain is attached to the lower wall of a breathing bag 10 having inlets connected to the canister outlets. The bag also has an outlet connected to air inhalation hose 14'.

When the breathing bag is substantially empty, valve sleeve 24 is in its upper position, shown in FIG. 2, in which it blocks the entrance to the carbon dioxide absorbing canister 12 while exhaled air flows down through the sleeve and out of the valve into canister 13 and then into the bag. As the bag becomes inflated, chain 11 pulls the valve sleeve downwardly to gradually open the line to canister 12 and close the outlet to the other canister. When the bag is fully inflated, as shown in FIG. *2a*, the sleeve is in its lower position and all air flow is through canister 12.

I claim:

1. Breathing apparatus comprising an oxygen liberating canister having an inlet and an outlet, a carbon dioxide absorbing canister having an inlet and an outlet, a breathing bag having two inlets and an outlet, an inhalation tube connected to the bag outlet, an exhalation tube, conduit means connecting the exhalation tube with said canister inlets and said canister outlets to said bag inlets, valve means in said conduit means for controlling the proportion of exhaled air flowing through each canister, said valve means normally being positioned to direct exhaled air flow through the oxygen liberating canister while shutting off air flow through the carbon dioxide absorbing canister, said valve means being movable to a second position to shut off air flow through the oxygen liberating canister and direct the air flow through the other canister, and means operated by said bag when it is inflated for moving said valve means from normal position to said second position.

2. Breathing apparatus according to claim 1, in which the form of said valve means is such that the exhaled air flows through both of said canisters at the same time when the bag is partly inflated.

3. Breathing apparatus according to claim 1, or 2, in which said valve means include a separate valve secured to said conduit means connecting each of said canister outlets to said bag inlets.

4. Breathing apparatus according to claim 3, in which said valve-actuating means is a flexible line connecting each of said valves with a side of the bag that pulls the line as the bag is inflated to open one of said air flow passages and close the other.

5. Breathing apparatus according to claim 3, in which said valves are located inside the bag.

6. Breathing apparatus according to claim 1, said valve means being a valve forming part of said conduit means.

7. Breathing apparatus according to claim 6, in which said valve-actuating means is a flexible line connecting said valve with the side of the bag remote from the valve for pulling the line as the bag is inflated.

8. Breathing apparatus according to claim 7, in which while the bag is deflated said valve is open to said oxygen liberating canister and closed to the other canister, and while the bag is fully inflated and pulling on said line the valve is closed to the oxygen liberating canister and open to the other canister.

* * * * *